US005425478A

United States Patent [19]

Kotaki et al.

[11] Patent Number: 5,425,478

[45] Date of Patent: Jun. 20, 1995

[54] CONTAINER HAVING A LEAK-FREE CLOSURE, RECORDING HEAD AND APPARATUS USED THEREWITH, AND METHOD OF INSTALLATION AND REMOVAL

[75] Inventors: Yasuo Kotaki; Kazuhiro Nakajima, both of Yokohama, Japan

[73] Assignee: Canon Kabushiki Kaisha, Tokyo, Japan

[21] Appl. No.: 81,708

[22] Filed: Jun. 25, 1993

[30] Foreign Application Priority Data

Jun. 30, 1992 [JP] Japan ..... 4-173235

[51] Int. Cl.[6] ..... B65D 25/38

[52] U.S. Cl. ..... 222/501; 251/149.1

[58] Field of Search ..... 251/149.1, 339; 222/322, 402.1, 402.25, 501

[56] References Cited

U.S. PATENT DOCUMENTS

| | | | |
|---|---|---|---|
| Re. 32,354 | 2/1987 | Savage | 222/501 X |
| 3,283,785 | 11/1966 | Beres et al. | 222/501 X |
| 3,586,068 | 6/1971 | Nicholson | 222/501 X |
| 4,313,124 | 1/1982 | Hara | 346/140 R |
| 4,345,262 | 8/1982 | Shirato et al. | 346/140 R |
| 4,353,488 | 10/1982 | Schneiter et al. | 222/501 |
| 4,437,487 | 3/1984 | Marmon | 222/501 X |
| 4,445,551 | 5/1984 | Bond et al. | 251/149.1 X |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,928,126 | 5/1990 | Asai | 346/140 R |
| 4,971,224 | 11/1990 | Scremin | 222/402.1 X |
| 5,014,887 | 5/1991 | Kopp | 222/501 X |
| 5,154,212 | 10/1992 | Weber | 222/501 X |

FOREIGN PATENT DOCUMENTS

| | | |
|---|---|---|
| 54-056847 | 5/1979 | Japan . |
| 59-123570 | 7/1984 | Japan . |
| 59-138461 | 8/1984 | Japan . |
| 60-071260 | 4/1985 | Japan . |
| 60-165249 | 8/1985 | Japan . |
| 63-013749 | 1/1988 | Japan . |
| 63-176635 | 11/1988 | Japan . |

*Primary Examiner*—Andres Kashnikow
*Assistant Examiner*—Kenneth Bomberg
*Attorney, Agent, or Firm*—Fitzpatrick, Cella, Harper & Scinto

[57] ABSTRACT

A container includes a main body having an outlet for supplying fluid from the main body and a sliding member movable in the outlet according to relative movement of a withdrawal member fitting the sliding member during the supply of fluid from the main body through the withdrawal member, thereby providing a simple detachable structure which does not leak.

5 Claims, 10 Drawing Sheets

CONTAINER HAVING A LEAK-FREE CLOSURE, RECORDING HEAD AND APPARATUS USED THEREWITH, AND METHOD OF INSTALLATION AND REMOVAL

BACKGROUND OF THE INVENTION

1. Field of the Invention

The present invention relates to a container, especially to a fluid container, for example, a liquid container such as a replaceable container for holding recording liquid used in pens or a food storing container, and a gas container such as a gas bomb or the like. The present invention particularly relates to an ink container for use in a recording apparatus such as an ink jet apparatus. The present invention also relates to a recording head unit used with such a container and a recording apparatus which uses the container. The present invention further related to a method for installation and removal of the container.

2. Related Background Art

Various types of containers have been used as liquid containers serving as replaceable recording liquid containers for storing ink used in pens, foods, and as containers for storing gas or the like. Typical examples of containers are illustrated in FIGS. 1A, 1B.

FIG. 1A is a schematic cross sectional view showing an example of a liquid container. As illustrated in FIG. 1A, a main body 1 has screw threads around an outlet 2 which can be covered by a reusable cover 3 having matching screw threads which engage the main body's screw threads to prevent a liquid from leaking out of the main body 1. Liquid 4 can be supplied as required from the main body 1 by unscrewing and removing the cover 3 from the outlet 2. In this example, high dimensional precision is required between the matching screw threads to give a tight fit to prevent liquid leakage from the main body 1. Moreover, it is almost impossible to supply liquid 4 from the main body 1 unless the cover 3 is completely taken away from the outlet 2. Therefore, the cover 3 must be quickly removed and quickly replaced, especially when volatile liquid or volatile gas is contained in the main body 1. Accordingly, it is difficult to withdraw the required amount of material from the main body 1. In addition, the main body 1 must be kept vertical because liquid will leak out unless the port 4 points upward.

FIG. 1B is a schematic cross sectional view showing an example of a gas container. Gas 13 can be supplied as desired from the main body 1 by turning a precision screw valve 14 which tightly seals an outlet 2. However, this example still has similar problems to those of the aforesaid example.

As an ink container for use in a recording apparatus such as an ink jet apparatus, various kinds of containers have been used. Typical examples of ink containers are illustrated in FIGS. 2A to 2C.

FIG. 2A is a schematic cross sectional view showing an example of an ink container. This schematic example is disclosed, for example, in Japanese Patent Laid-Open (Kokai) No. 60-165249. Liquid 4 such as ink can be supplied as necessary from the main body 1 by causing a needle 6 held by a tube 7 to pierce a rubber plug 41 held at a port 2 by a holding member 5. In this example, liquid 4 can usually be supplied well in any position of the main body 1. However, it happens that a hole is formed in the rubber plug 41 after multiple stabs and removals of the needle 6 which can cause a liquid leak. In addition, the needle 6 is dangerous for the operator.

FIG. 2B is a schematic cross sectional view showing another improved example of an ink container. This schematic example is disclosed, for example, in Japanese Utility Model Laid-Open (Kokai) No. 63-176635. In this example, in addition to the aforesaid example, a shield 11 is provided around the needle, and a groove 12 corresponding to the shield 11 is also provided to the main body 1 in order to keep the operator safe. However, it still happens that a hole is formed in the rubber plug after plural stabs and removals of the needle 6, causing a liquid leak. Moreover, the configuration becomes so complicated that it is relatively expensive.

FIG. 2C is a schematic cross sectional view showing another example of an ink container. This schematic example is disclosed, for example, in Japanese Patent Laid-Open (Kokai) No. 63-13749. The outlet 2 is ordinarily closed because the spring member 9 pushes the spherical member 8 against a rubber-like elastic stopping member 10. Liquid 4 such as ink can be supplied as desired from the main body 1 by inserting a tube 7 into outlet 2 to push the spherical member 8 made of stainless steel, plastics or the like inward. In this example, liquid 4 can usually be supplied well in any position of the main body 1. However, at least 3 parts, the spherical member 8, the spring member 9 and the stopping member 10, are necessary. Therefore, the configuration also becomes so complicated that it is relatively expensive.

SUMMARY OF THE INVENTION

The present invention has been developed in consideration of the above situation. It is an object of the present invention to provide an improved container, an improved recording head unit with the container, an improved recording apparatus for use of the container, and an improved method for installation and removal of the container each of which can overcome the problems described above.

It is another object of the present invention to provide a container, a recording head unit with the container, a recording apparatus for use of the container, and a method for installation and removal of the container each of which can provide a simple detachable structure not subject to fluid leakage.

It is still another object of the present invention to provide a container, a recording head unit with the container, a recording apparatus for use of the container, and a method for installation and removal of the container each of which can provide a detachable structure that is safe for the operator.

It is further another object of the present invention to provide a container, a recording head unit with the container, a recording apparatus for use of the container, and a method for installation and removal of the container in which the detachable structure has a minimum number of parts and which takes advantage of relative movement of a withdrawal member for installation and removal of the container.

According to one aspect of the present invention, a container comprises a main body with an outlet for supplying fluid out of the main body and a sliding member movable in the outlet according to relative movement of a withdrawal member fitting the sliding member while fluid is supplied from the main body through the withdrawal member.

According to another aspect of the present invention, a recording head unit comprises a container including a main body with an outlet for supplying fluid from the main body and a sliding member movable in the outlet according to relative movement of a withdrawal member fitting the sliding member while fluid is supplied from the main body through the withdrawal member, and a recording head carrying out recording with fluid supplied through the withdrawal member.

According to still another aspect of the present invention, a recording apparatus is provided carrying out recording with fluid using a container that comprises a main body with an outlet for supplying fluid from the main body and a sliding member movable in the outlet according to relative movement of a withdrawal member fitting the sliding member while fluid is supplied from the main body through the withdrawal member.

According to yet another aspect of the present invention, a method for installation and removal of a container comprising a main body with an outlet for supplying fluid out of the main body through a withdrawal member comprises the steps of:

installing the main body by moving a sliding member movable in the outlet inward according to relative movement of the withdrawal member fitting the sliding member to make fitting engagement between the sliding member and the withdrawal member and to make communication between the inside of the main body and the withdrawal member, and a step of removing the main body in which the sliding member is moved outward according to the relative movement of the withdrawal member to prevent communication and to release the fitting.

Other objects, features and advantages of the present invention will become apparent from the following detailed description of the preferred embodiments of the present invention and the accompanying drawings.

DESCRIPTION OF THE PREFERRED EMBODIMENTS

The present invention is described in detail with reference to the preferred embodiments mentioned below.

Figure 1A:
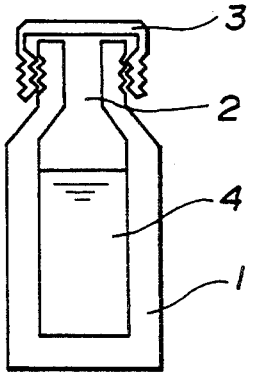
FIG.1A PRIOR ART
FIG. 1A is a schematic cross sectional view showing an example of a liquid container.
Figure 1B:
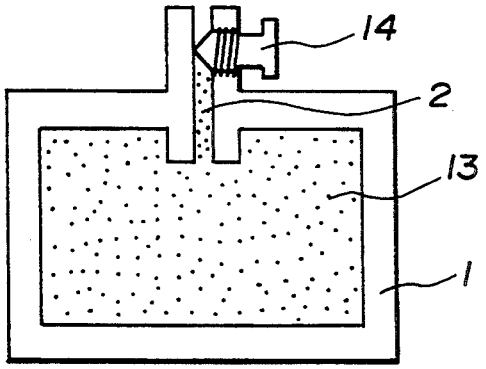
FIG.1B PRIOR ART
FIG. 1B is a schematic cross sectional view showing an example of a gas container.
Figure 2A:
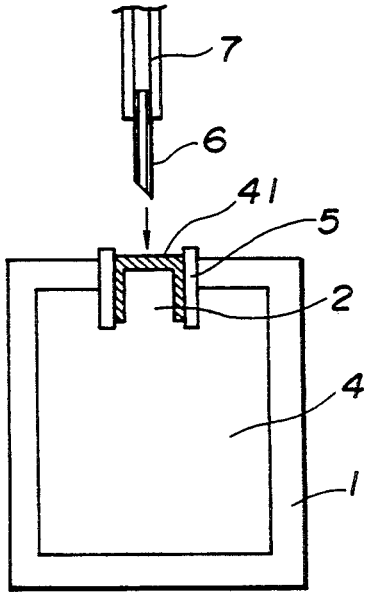
FIG.2A PRIOR ART
FIG. 2A is a schematic cross sectional view showing an example of an ink container.
Figure 2B:
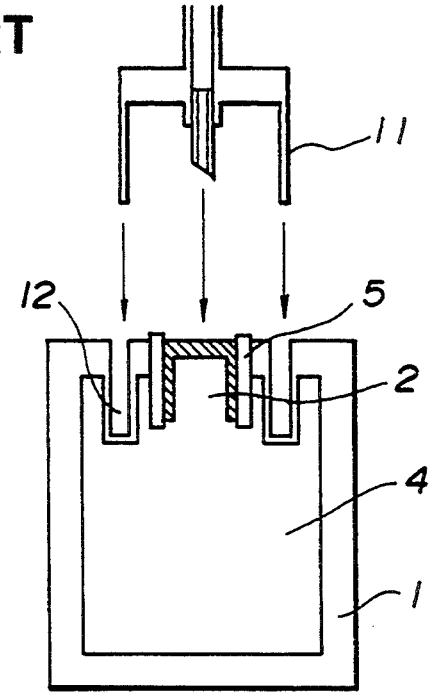
FIG.2B PRIOR ART
FIG. 2B is a schematic cross sectional view showing another improved example of an ink container.
Figure 2C:
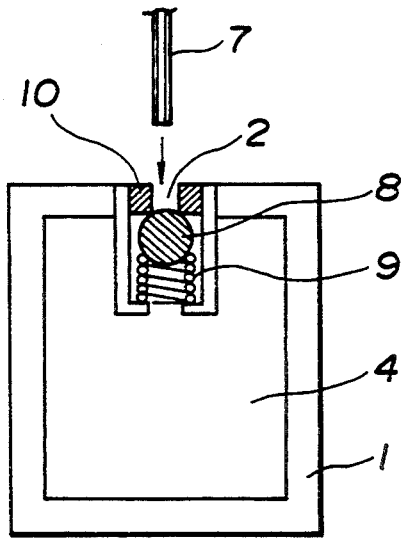
FIG.2C PRIOR ART
FIG. 2C is a schematic cross sectional view showing another example of an ink container.
Figure 3:
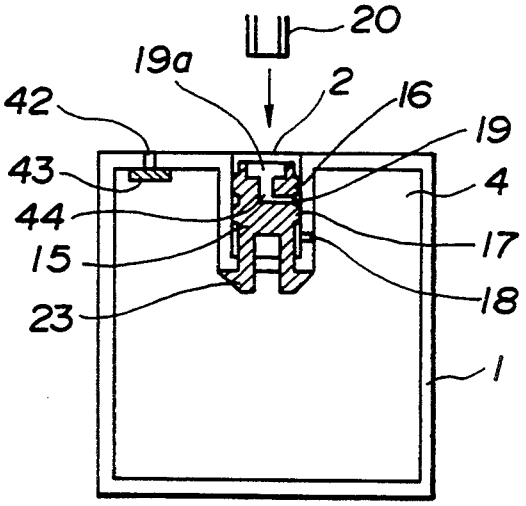
FIG. 3 is a schematic cross sectional view showing a first embodiment of the present invention.
Figure 4A:
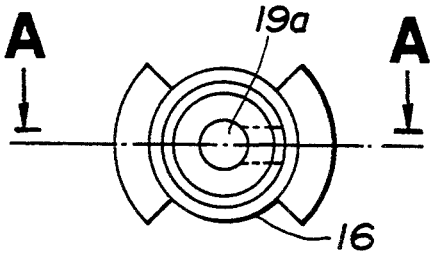
FIGS. 4A, 4B and 4C are a schematic top view, a schematic side view and a schematic bottom view, respectively, showing a sliding member as a part of a container of this first embodiment.
Figure 4B:
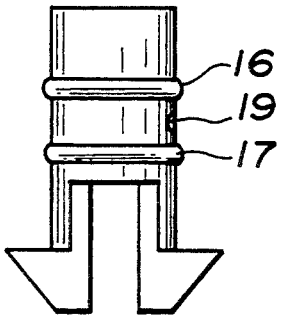
Figure 4C:
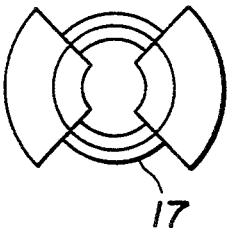

FIG. 3 is a schematic cross sectional view showing a first embodiment of the present invention. FIGS. 4A, 4B and 4C are a schematic top view, a schematic side view and a schematic bottom view respectively showing a sliding member 15 mentioned below as a part of a container of this first embodiment. FIG. 3 is a schematic cross sectional view taken on line A—A of FIG. 4A.

As illustrated in FIG. 3, a main body 1 is filled with liquid 4 such as ink. Liquid 4 is supplied out from main body 1 though an outlet 2 formed in the main body 1. A sliding member 15 is provided in the outlet 2. The sliding member is preferably made of elastic material.

As illustrated in FIGS. 4A to 4C, projecting portions 16, 17 are provided all around the sliding member 15. These projecting portions 16, 17 are in contact with an inside wall of the outlet 2 to prevent liquid from leaking out of the main body 1. A port 19*a* of the sliding member 15 on the side of the outlet 2 and a port 19 of the sliding member 15 formed between the projecting portion 16 and the projecting portion 17 communicate with each other through a liquid supply passage 44. An aperture 18 is formed in the outlet 2 further inside of the main body 1 than the contact position between the projecting portion 17 and the inside wall of the outlet 2, as shown in FIG. 3. A vent 42 to the atmosphere is provided with a structure for preventing liquid leakage therefrom is provided in the main body 1. In this embodiment, a filter 43 permeable only to gas is provided.

Figure 5:
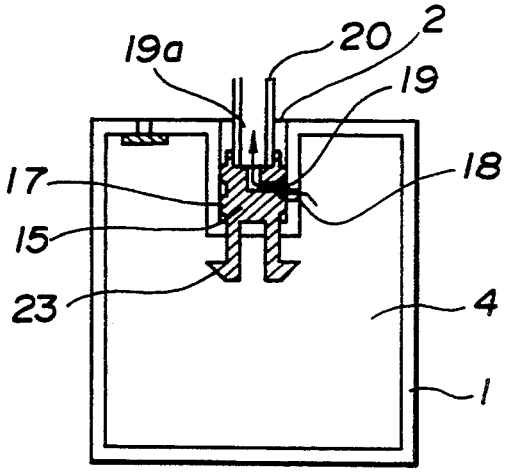
FIG. 5 is a schematic cross sectional view showing another view of the first embodiment.

FIG. 5 is a schematic cross sectional view showing another view of the first embodiment. As illustrated in FIG. 5, a tube 20 serving as a withdrawal member is inserted into the outlet 2 to push the sliding member 15 shown in FIG. 3 downward after fitting the tube 20 into the port 19*a* of the sliding member 15. Liquid 4 can be withdrawn from the main body 1 when the aperture 18 of the main body 1 and the port 19 of the sliding member 15 communicate with each other. In FIG. 5, liquid flow is designated by an arrow.

After an adequate amount of liquid 4 is supplied from the main body 1, the tube 20 is removed from the outlet 2. The sliding member 15 is in frictional contact with the tube 20 that moves upward as shown in FIG. 5, and moves upward with tube 20 until the parts are oriented approximately as shown in FIG. 3. Communication between the inside and the outside of the main body 1 through the liquid supplying passage 44 is prevented before the separation of the tube 20 from the sliding member 15.

It is preferable that the relationship $L_1 < L_2$ be satisfied, $L_1$ being the inside diameter of the port 19*a* of the sliding member 15, and $L_2$ being the outside diameter of the tube 20. And also, it is preferable that the sliding resistance between the projecting portions 16, 17 and the inside wall of the outlet 2 is less than the fitting resistance between the tube 20 and the sliding mender 15. If the aforesaid preferred conditions are satisfied, the sliding member 15 can return to the beginning situation illustrated in FIG. 3 more readily. The sliding resistance between the projecting portions 16, 17 and the inside wall of the outlet 2 is preferably large enough to prevent the sliding member 15 from shifting in the outlet 2 as a result of the usual vibrations but also prevents shifting if the main body 1 falls, or the like.

Figure 6A:
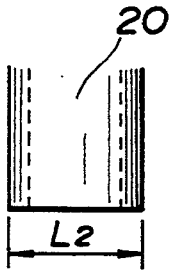
FIG. 6A is a schematic partial enlarged view showing a portion of a tube of the first embodiment.
Figure 6B:
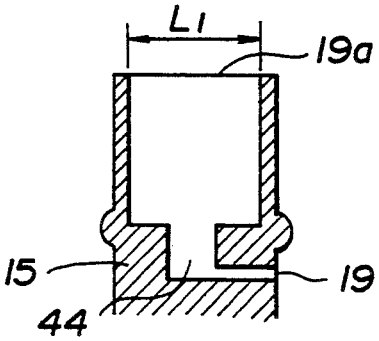
FIG. 6B is a schematic partial enlarged cross sectional view showing a portion of the sliding member of the first embodiment.

FIG. 6A is a schematic partial enlarged view showing a portion of the tube of the first embodiment. FIG. 6B is a schematic partial enlarged cross sectional view showing a portion of the sliding member of the first embodiment.

Figure 6C:
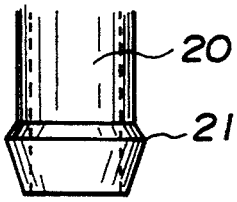
FIG. 6C is a schematic partial enlarged view showing a portion of a tube of a second embodiment.
Figure 6D:
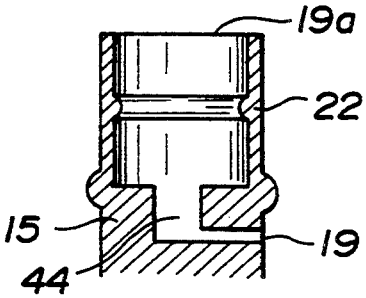
FIG. 6D is a schematic partial enlarged cross sectional view showing a portion of a sliding member of the second embodiment.

FIG. 6C is a schematic partial enlarged view showing a portion of a tube of a second embodiment. FIG. 6D is a schematic partial enlarged cross sectional view showing a portion of a sliding member of the second embodiment. Referring to the second embodiment, the fitting resistance between the tube 20 and the sliding member 15 is larger than that in the first embodiment because a projecting portion 21 is also provided around the tube 20 and a corresponding projecting portion 22 is provided inside the port 19*a* of the sliding member 15. The sliding member 15 is designed so that the inside wall of the port 19*a* of the sliding member 15 is firmly secured to tube 20 to allow it to return to its original position with certainty. The tube 20 is able to separate from the sliding member 15 as the sliding member 15 returns to its original position because a separation preventing member 23 provided integrally on the sliding member 15 prevents the sliding member 15 from separating from the main body 1.

Figure 7:
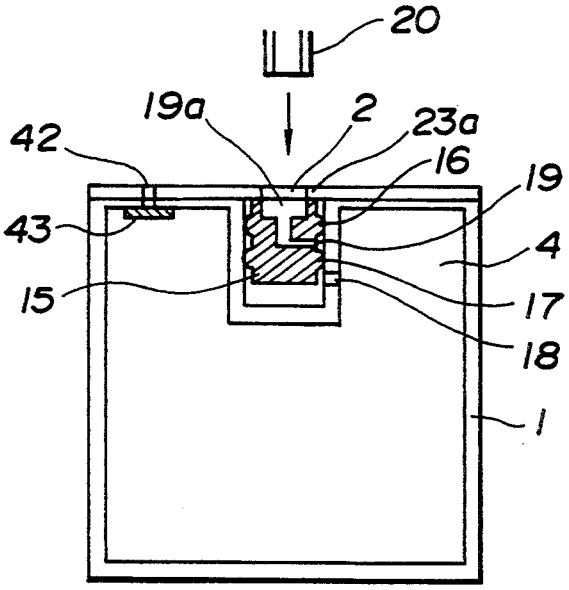
FIG. 7 is a schematic cross sectional view showing a third embodiment of the present invention.

FIG. 7 is a schematic cross sectional view showing a third embodiment of the present invention. In the third embodiment, a separation preventing member 23*a* is provided not on the side of a sliding member 15 but is an integral part of the main body 1. This type of separation preventing member 23*a* is preferable because it can be used not only to prevent the sliding member 15 from separating from the main body 1 but also to guide a tube 20 during insertion of the tube 20.

The tube 20 may fit into the sliding member 15 after communication is established between the inside and the outside of the main body 1 through a liquid passage of the sliding member 15 provided the edge portion of the tube 20 and the port 19*a* of the sliding member 15 tightly contact each other. However, it is preferable that the tube 20 fits into the sliding member 15 before communication between the inside and the outside of the main body 1 is established through the liquid passage of the sliding member 15 to supply liquid reliably.

In order to provide a secure fit between the tube 20 and the sliding member 15 before the sliding member 15 begins to move downward as shown in FIG. 7, it is necessary that the sliding resistance between the tube 20 and the port 19*a* of the sliding member 15 during insertion of the tube 20 be smaller than the fitting resistance between the sliding member 15 and the outlet 2. In order to facilitate separation of the tube 20 and the sliding member 15 after the sliding member 15 has finished moving upward, as shown in FIG. 7, it is necessary that the fitting resistance between the tube 20 and the port 19*a* of the sliding member 15 during removal of the tube 20 be larger than the sliding resistance between the sliding member 15 and the outlet 2.

Figure 8A:
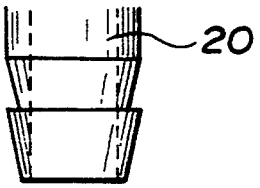
FIG. 8A is a schematic partial enlarged view showing a portion of a tube of a fourth embodiment.
Figure 8B:
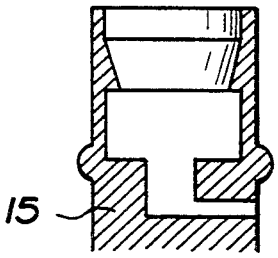
FIG. 8B is a schematic partial enlarged cross sectional view showing a portion of a sliding member of the fourth embodiment.

FIG. 8A is a schematic partial enlarged view showing a portion of a tube of a fourth embodiment. FIG. 8B is a schematic partial enlarged cross sectional view showing a portion of a sliding member of the fourth embodiment. In the fourth embodiment, the tube 20 and sliding member 15 have the particular shapes illustrated in FIGS. 8A and 8B so that the sliding resistance and the fitting resistance between the tube 20 and the port 19*a* of the sliding member 15 have the aforesaid relationships according to whether tube 20 is being inserted or withdrawn.

Figure 9:
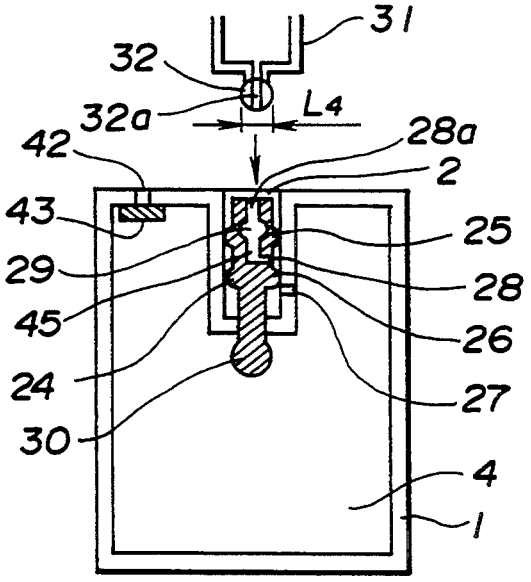
FIG. 9 is a schematic cross sectional view showing a fifth embodiment of the present invention.
Figure 10A:
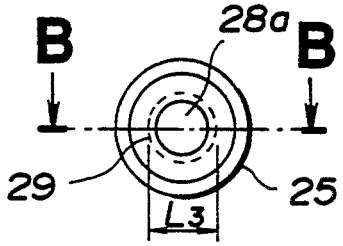
FIGS. 10A, 10B and 10C are a schematic top view, a schematic side view and a schematic bottom view, respectively, showing a sliding member as a part of a container of this fifth embodiment.
Figure 10B:
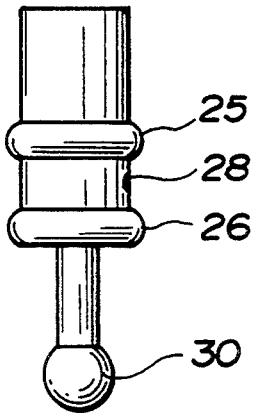
Figure 10C:
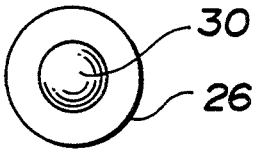

FIG. 9 is a schematic cross sectional view showing a fifth embodiment of the present invention. FIGS. 10A, 10B and 10C are a schematic top view, a schematic side view and a schematic bottom view respectively showing a sliding member 24 discussed below as a part of a container of this fifth embodiment. FIG. 9 is a schematic cross sectional view taken on line B—B of FIG. 10A.

As illustrated in FIG. 9, a container 1 is filled with liquid 4 such as ink. Liquid 4 is supplied from the main body 1 though an outlet 2 formed in the main body 1. A sliding member 24 is provided in the outlet 2. The sliding member is preferably made of elastic material.

As illustrated in FIGS. 10A to 10C, projecting portions 25, 26 are provided all around the sliding member 24. These projecting portions 25, 26 contact an inside wall of the outlet 2 to prevent liquid from leaking out of the main body 1. A port 28*a* of the sliding member 24 on the side of the outlet 2 and a port 28 of the sliding member 24 formed between the projecting portion 25 and the projecting portion 26 communicate with each other through a liquid supplying passage 45. An aperture 27 is formed in the outlet 2 disposed further inside of the main body 1 than the contact position between the projecting portion 26 and the inside wall of the outlet 2, as shown FIG. 9. A vent 42 to the atmosphere having a structure for preventing liquid leaks is provided in the main body 1. In this embodiment, a filter 43 permeable only to gas is provided.

Figure 11:
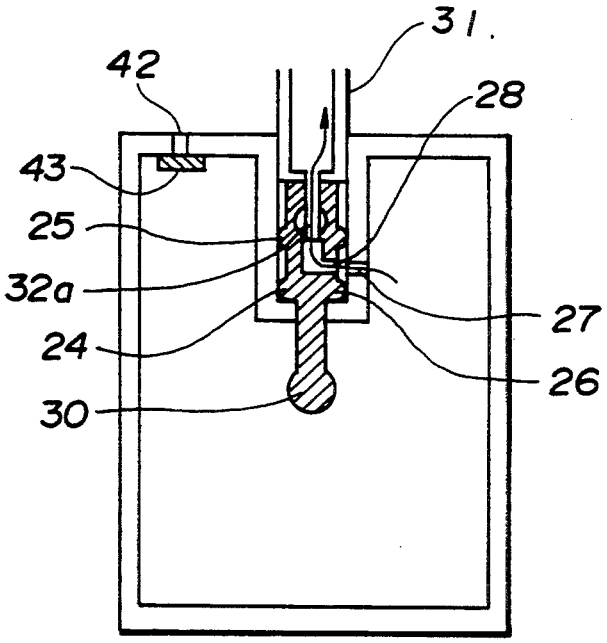
FIG. 11 is a schematic cross sectional view showing another situation of the fifth embodiment.

FIG. 11 is a schematic cross sectional view showing another view of the fifth embodiment. As illustrated in FIG. 11, a tube 31 is inserted into the outlet 2 to push the sliding member 24 of FIG. 9 downward after a spherical projection 32 at the edge of the tube 31 fits into a concave portion 29 through the port 28*a* of the sliding member 24. Liquid 4 can be supplied from the main body 1 when the aperture 27 of the main body 1, the port 28 of the sliding member 24 and a port 32*a* of the spherical projection 32 communicate with one another. In FIG. 11, liquid flow is designated by an arrow.

After an adequate amount of liquid 4 is withdrawn from the main body 1, the tube 31 is pulled out of the outlet 2. The sliding member 24 in frictional contact with the tube 31 moves upward with the upward movement of the tube 31 as shown in FIG. 11 until device returns to the original position illustrated in FIG. 9. Communication between the inside and the outside of the main body 1 through the liquid supplying passage 45 ceases before the separation of the tube 31 from the sliding member 24.

It is preferable that the expression $L_3 < L_4$ is satisfied where $L_3$ is the inside diameter of the concave portion 29 of the sliding member 24, and $L_4$ is the outside diameter of the spherical projection 32. And also, it is preferable that the sliding resistance between the projecting portions 25, 26 and the inside wall of the outlet 2 is less than the fitting resistance between the spherical projection 32 and the sliding member 24. If the aforesaid preferred conditions are satisfied, the sliding member 24 can return to its original position illustrated in FIG. 9 more readily.

In the fifth embodiment, the tube 31 is not easily separated from the sliding member 24 because the spherical projection 32 is forced to fit tightly in the concave portion 29. Therefore, liquid supply can be carried out very reliably. In addition, the communication between the inside and the outside of the main body 1 through the liquid supplying passage 45 can be terminated with certainty because the sliding member 24 positively follows the tube 31 during the movement of the tube 31 upward in FIG. 11. The tube 31 is released from the sliding member 24 returned to its original position because a separation preventing member 30 provided at the edge of the sliding member 24 prevents the sliding member 24 from separating from the container 1.

Figure 12:
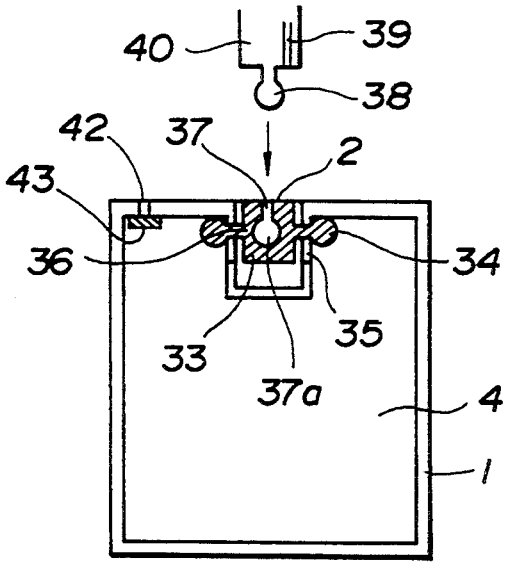
FIG. 12 is a schematic cross sectional view showing a sixth embodiment of the present invention.
Figure 13A:
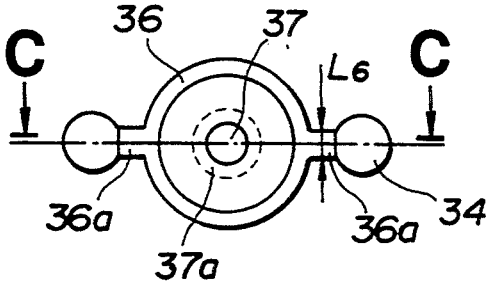
FIGS. 13A, 13B and 13C are a schematic top view, a schematic side view and a schematic bottom view, respectively showing a sliding member as a part of a container of the sixth embodiment.
Figure 13B:
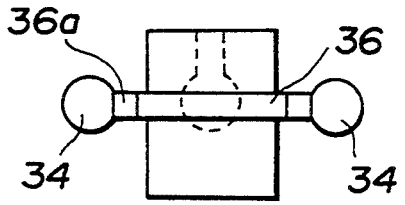
Figure 13C:
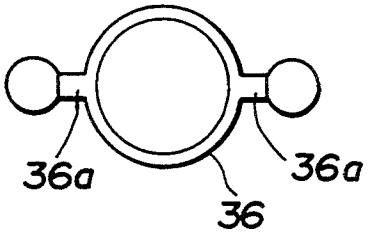

FIG. 12 is a schematic cross sectional view showing a sixth embodiment of the present invention. FIGS. 13A, 13B and 13C are a schematic top view, a schematic side view and a schematic bottom view respectively showing a sliding member 33 mentioned below as a part of a container of this sixth embodiment. FIG. 12 is a schematic cross sectional view taken on line C—C of FIG. 13A.

As illustrated in FIG. 12, a main body 1 is filled with liquid 4 such as ink. Liquid 4 is supplied from the main body 1 though an outlet 2 formed in the main body 1. A sliding member 33 is provided in the outlet 2. The sliding member is preferably made of elastic material.

Figure 14:
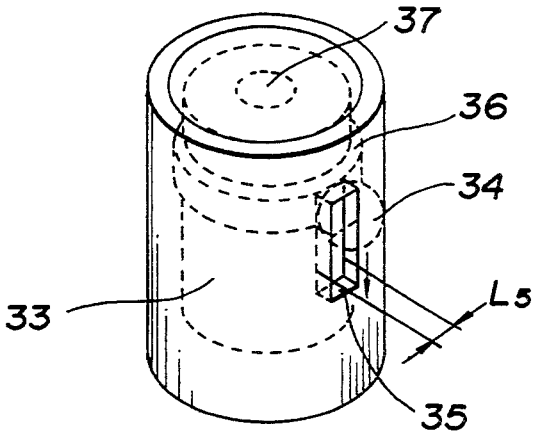
FIG. 14 is a schematic perspective enlarged view showing a portion of the container around an outlet of the sixth embodiment

FIG. 14 is a schematic perspective enlarged view showing a portion of the main body 1 surrounding the outlet 2. As illustrated in FIGS. 13A to 13C and 14, a projecting portion 36 is provided all around the sliding member 33. This projecting portion 36 is in contact with an inside wall of the outlet 2 to prevent liquid leaking from the main body 1. Two spherical members 34 are suspended by necks 36*a* protruding from the projection portion 36. The diameter of each spherical member 34 is larger than the width $L_6$ of each neck 36*a*. The necks 36*a* are in contact with upper surfaces of slits 35 $L_5$ wide formed on the side of the outlet 2 to prevent liquid leaking from the main body 1. A vent 42 to the atmosphere with structure for preventing liquid leakage is provided in the main body 1. In this embodiment, a filter 43 permeable only to gas is provided.

Figure 15:
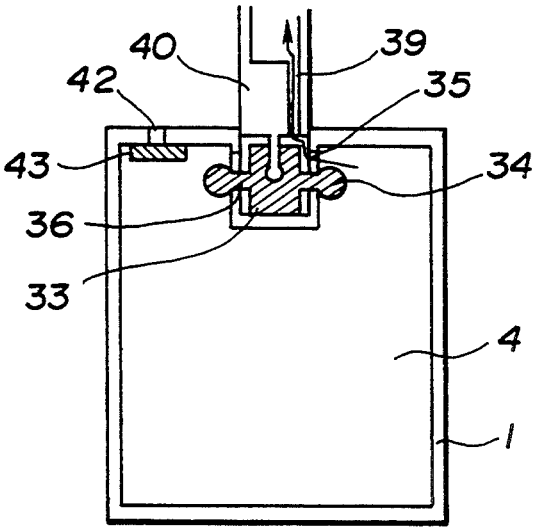
FIG. 15 is a schematic cross sectional view showing another view of the sixth embodiment.

FIG. 15 is a schematic cross sectional view showing another view of the sixth embodiment. As illustrated in FIG. 15, a tube 40 is inserted into the outlet 2 to push the sliding member 33 downward as shown in FIG. 12 after a spherical projection 38 at the edge of the tube 40 fits into a concave portion 37*a* through the port 37 of the sliding member 33. The necks 36*a* are situated at lower positions of the slits 35 to open upper portions of the slits 35. Liquid 4 can be supplied from the main body 1 when upper portions of the slits 35 of the main body 1 and a port 39 of the tube 40 communicate with each other. In FIG. 15, the liquid flow is designated by an arrow. In this situation, the outside diameter of the tube 40 is larger than the inside diameter of the outlet 2 to be in contact with the inside wall of the outlet 2.

After the desired amount of liquid 4 is supplied from the main body 1, the tube 40 is pulled out of the outlet 2. The sliding member 33 in frictional contact with the tube 40 and so moves upward along with tube 40 as shown in FIG. 15 until the device returns to its original state illustrated in FIG. 12. Communication between the inside and the outside of the main body 1 through the upper portions of the slits 35 is terminated before the separation of the tube 40 from the sliding member 33. The inside diameter of the concave portion 37*a* is smaller than the outside diameter of the spherical projection 38 to insure a tight fit between the concave portion 37*a* and the spherical projection 38. This fitting is tight enough so that the sliding member 33 can return to the original position illustrated in FIG. 12 despite the sliding resistance between the projection portion 36 and the inside wall of the outlet 2 and that between the necks 36*a* and the slits 35. The tube 40 is released from the sliding member 33 at the time of return to the original position because the spherical member 34 functions as a separation preventing member to prevent the sliding member 33 from separating from the container 1.

In the sixth embodiment, the tube 40 is not easily separated from the sliding member 33 because the spherical projection 38 is forced to fit tightly in the concave portion 37*a*. Therefore, liquid can be supplied very reliably. In addition, the communication between the inside and the outside of the main body 1 through the upper portions of the slits 35 can be terminated because the sliding member 33 follows the tube 40 during the movement of the tube 40 upward as shown in FIG. 15. Moreover, the sixth embodiment only requires simple structure of low cost mainly because it is unnecessary to form a liquid passage in the sliding member.

Figure 16:
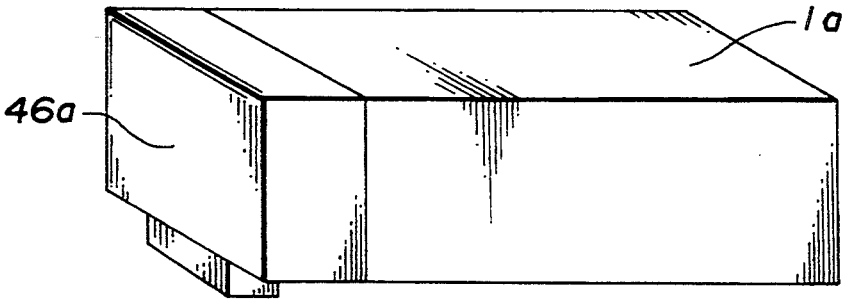
FIG. 16 is a schematic perspective view showing an example of a recording head unit of the present invention.

FIG. 16 is a schematic perspective view showing an example of a recording head unit of the present invention. The recording head unit has an integral container la with the aforesaid structure for supplying ink in the container la and a recording head 46*a* with a tube (not shown) for receiving ink from the container 1*a*. The recording head has, for example, a discharge opening (not shown) for discharging ink to record images (the term "images" herein includes characters) according to image information (the term "image information" herein includes character information or the like) on a recording medium such as paper, thin plastic film, textiles or any other medium capable of having an image recorded thereon. The recording head 46*a* has, for example, an energy generating body (not shown) for generating energy to be utilized to discharge ink from the discharge opening. The energy generating body may be a thermal energy generating body such as an electrothermal converting body or a kinetic energy generating body such as a piezoelectric body.

Figure 17:
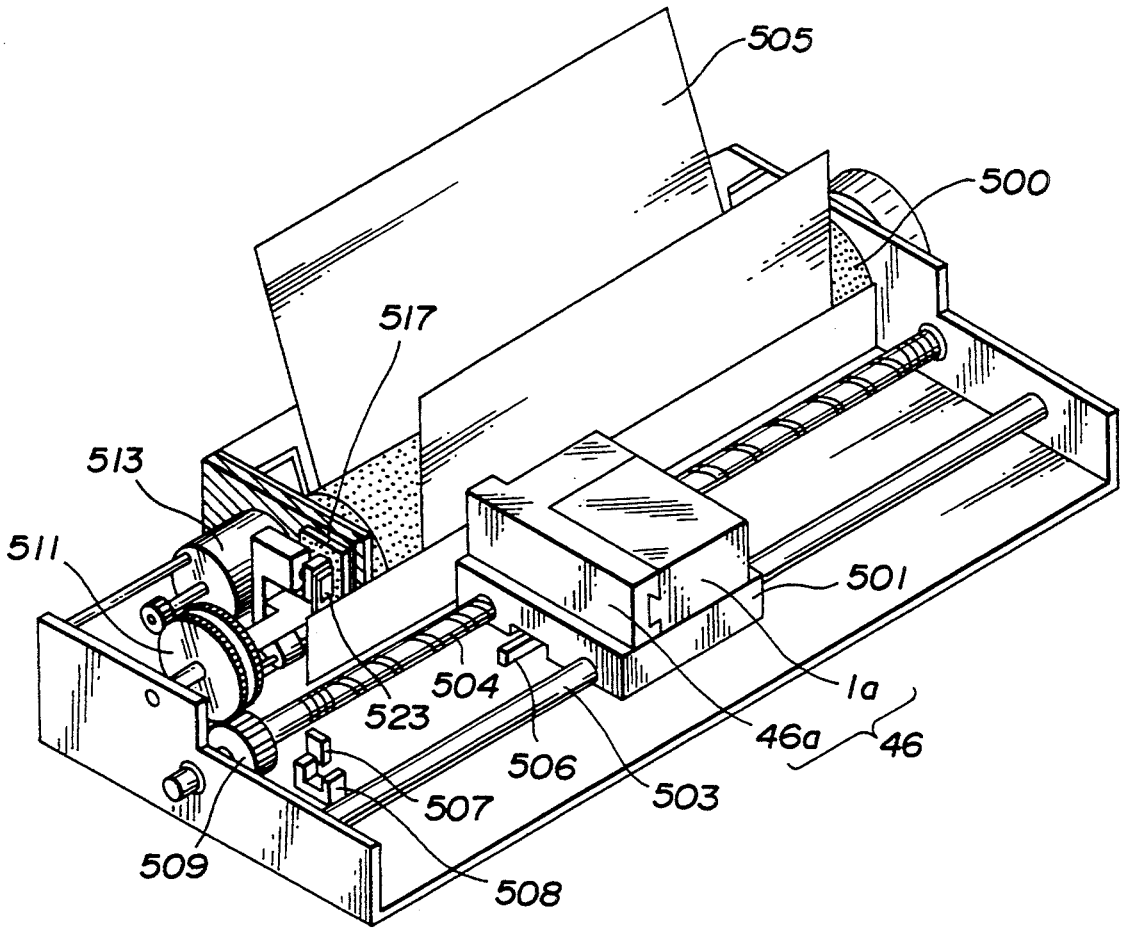
FIG. 17 is a schematic perspective view showing a main portion of a recording apparatus of the present invention.

FIG. 17 is a schematic perspective view showing a main portion of a recording apparatus employing the present invention. This recording apparatus is an ink jet recording apparatus. As illustrated in FIG. 17, a recording head unit 46 with a container 1*a* and a recording head 46*a* is mounted on and carried by a carriage 501, which is supported along guide shafts 503, 504 to allow reciprocable motion. A recording medium 505 such as paper, plastic sheet or cloth sheet is conveyed in a sub-scanning direction transverse to the main scanning movement of the carriage 501 through a recording area, which is in a range of the movement of the carriage 501. In the recording area, a predetermined gap (a flying distance of an ink droplet, for example 0.8 mm) is provided between a front surface (a surface with the discharge opening) of the recording head 46 and a recording surface of the recording medium 505. Plural discharge openings are provided on the front surface of the recording head in a line substantially transverse to the main scanning direction of the movement of the carriage 501.

The movement of the carriage 501 is carried out according to rotation of the shaft 504 driven by a carriage driving motor 513 through transmission gears 511, 509. Conveyance of the recording medium 505 is carried out using platen roller 500 as a conveying means. The recording of one line onto the recording medium 505 is carried out by discharging ink from selected discharge openings in response to image signals applied in synchronism with the movement (main scanning) of the ink jet head 46 while the recording medium 505, which is disposed in the recording area, is suspended. Timings of the discharge of ink are controlled according to the outputs of a control circuit. After recording one line, the conveyance (sub-scanning) of the recording medium 505 for one line is carried out. Then the recording of the next line is carried out during the movement (main scanning) of the ink jet head 46*a*. The main scanning and the sub-scanning are repeated alternately. In this way, desired images are printed on the recording medium 505.

A recovery apparatus for maintaining and recovering a discharge capability of the recording head 46*a* is generally situated at a predetermined position, for example a home position of the carriage 501, which is in the range of the movement of the carriage 501 but out of the recording area. The numerals 507 and 508 designates a photo-coupler for sensing with a lever 506 on the carriage 501 whether the carriage 501 is situated at the home position or not. This recovery apparatus has a cap mender 523 for covering and closing tightly the discharge openings of the recording head 46 from the atmosphere, a cleaning wiper member 517 for wiping off extraneous matter like viscous ink on the surface of the discharge openings of the recording head 46*a*, and a suction pump (not illustrated in FIG. 17) connected to the cap member 523 for carrying out the suction recovery operation by applying suction to the discharge openings when they are covered by the cap member 523.

The present invention is particularly useful in an ink jet recording head unit and an ink jet recording apparatus with the unit in which ink is discharged by utilizing thermal energy. This embodiment has a high density of picture elements and high resolution of recording is possible.

The typical structure and the operational principle of the ink jet apparatus are disclosed in U.S. Pat. Nos. 4,723,129 and 4,740,796. These principles are applicable to both a so-called on-demand type recording system and a continuous type recording system. Particularly, however, it is suitable for the on-demand type because the principles are such that at least one driving signal is applied to an electrothermal transducer disposed on a liquid (ink) retaining sheet or a liquid passage, the driving signal being sufficient to provide a quick temperature rise which causes departure from nucleate boiling, by which the thermal energy is provided by the electrothermal transducer to produce film boiling on the heating portion of the recording head, whereby a bubble can be formed in the liquid (ink) corresponding to each of the driving signals. By development and collapse of the bubble, the liquid (ink) is ejected through an ejection outlet (a discharge opening) to produce at least one droplet. The driving signal is preferably in the form of a pulse, because development and collapse of the bubble can be effected instantaneously, and therefore, the liquid (ink) is ejected with quick response. The driving signal in the form of pulses is preferably such as that disclosed in U.S. Pat. Nos. 4,463,359 and 4,345,262. In addition, the temperature increasing rate of the heating surface is preferably such as is disclosed in U.S. Pat. No. 4,313,124.

The structure of the recording head may be as shown in U.S. Pat. Nos. 4,558,333 and 4,459,600 wherein the heating portion is disposed at a bent region, in addition to the structure of the combination of the ejection outlet, liquid passage and the electrothermal transducer disclosed in the above-mentioned patents. In addition, the present invention is applicable to the structure disclosed in Japanese Patent Laid-Open (Kokai) No. 59-123670, wherein a common slit is used as the ejection outlet for plural electrothermal transducers, and to the structure disclosed in Japanese Patent Laid-Open (Kokai) No. 59-138461, wherein an opening for absorbing a pressure wave by the thermal energy is formed corresponding to the ejecting portion. This is because the present invention is effective to perform the recording operation with certainty and at high efficiency regardless of the type of the recording head.

The present invention is effectively applicable to a so-called full-line type recording head having a length corresponding to the maximum recording width. Such a recording head may comprise a single recording head or plural recording heads combined to cover the entire width.

The provision of the recovery means and the auxiliary means for the preliminary operation are preferable, because they can further stabilize the operation and benefits of the present invention. As for such means, there are capping means for the recording head, cleaning means therefor, pressing or suction means, preliminary heating means by the ejection electrothermal transducer or by a combination of the ejection electrothermal transducer and an additional heating element and means for preliminary ejection (not for the recording operation), which can stabilize the recording operation.

As regards the kinds of recording head, it may be a single head corresponding to a single color ink, or may be plural heads corresponding to a plurality of ink materials having different recording colors or densities. The present invention is effectively applicable to an apparatus having at least one of a monochromatic mode for recording mainly with black ink material and a multicolor mode for recording with a mixture of the colors and may be an integrally formed recording unit or a combination of plural recording heads.

Furthermore, in the foregoing embodiments, the ink material has been liquid. It also may be, however, an ink material that solidifies at or below room temperature and liquefies at room temperature. Since in the ink jet recording system the ink is maintained within a temperature range not lower than 30° C. and not higher that 70° C. in order to stabilize the viscosity of the ink to ensure stabilized ejection, in usual recording apparatuses of this type, the ink is such that it is liquid within the temperature range when the recording signal is applied. In addition, a temperature rise due to the thermal energy may be positively prevented by utilizing the thermal energy for the state change of the ink from the solid state to the liquid state, or the ink material solidifying when it is left unused may be used to prevent the evaporation of the ink. In either case, upon the application of the recording signal producing thermal energy, the ink may be liquefied, and the liquefied ink may be ejected. The ink may start to solidify at the time it reaches the recording medium. The present invention is applicable to such an ink material as is liquefied by the application of the thermal energy. Such an ink material may be retained as a liquid or solid material through holes or recesses formed in a porous sheet as disclosed in Japanese Patent Laid-Open (Kokai) Nos. 54-56847 and 60-71260. The sheet is disposed facing the electrothermal transducers. The most effective system for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions, and of course is not limited thereto.

What is claimed is:

1. A container for use in an apparatus, said apparatus having a withdrawal member, said container comprising:

a main body having an outlet for supplying fluid from said main body, said outlet having a slit through which said fluid is supplied; and a sliding member movably disposed for sliding member movement in a direction within said outlet according to relative movement of said withdrawal member and having a portion into which said withdrawal member fits, said sliding member comprising a guiding member engaged with said slit for guiding the sliding member movement and closing said outlet, wherein said slit and said guiding member prevent said sliding member from separating from said main body and said fluid is supplied through a portion of said slit when said sliding member is moved by said withdrawal member.

2. A container according to claim 1, wherein said slit is provided in an inner wall of said outlet along the direction of the sliding member movement and said guiding member comprises a projection portion for closing said outlet and a protruding portion for guiding the sliding member movement.

3. A container according to claim 1, wherein a sliding resistance between said outlet of said main body and said sliding member is smaller than a fitting resistance between said sliding member and said withdrawl member.

4. A container according to claim 1, wherein said sliding member forms a fluid passage in said outlet for fluid flowing from said slit.

5. A container according to claim 1, wherein said fluid is ink.

* * * * *